US005681152A

United States Patent [19]

Åhs

[11] Patent Number: 5,681,152

[45] Date of Patent: Oct. 28, 1997

[54] MEMBRANE TYPE FLUID PUMP

[75] Inventor: Wilgot Åhs, Koppom, Sweden

[73] Assignee: SEM, AB, Amål, Sweden

[21] Appl. No.: 537,659

[22] PCT Filed: Apr. 8, 1994

[86] PCT No.: PCT/SE94/00313

§ 371 Date: Dec. 11, 1995

§ 102(e) Date: Dec. 11, 1995

[87] PCT Pub. No.: WO94/24437

PCT Pub. Date: Oct. 27, 1994

[30] Foreign Application Priority Data

Apr. 8, 1993 [SE] Sweden ..... 9301189

[51] Int. Cl.[6] ..... F04B 17/00

[52] U.S. Cl. ..... 417/413.2; 417/413.1; 347/68

[58] Field of Search ..... 417/413.1, 413.2, 417/413.3, 322; 347/68

[56] References Cited

U.S. PATENT DOCUMENTS 4,383,264 5/1983 Lewis ..... 347/68
4,520,375 5/1985 Kroll ..... 417/413.1
4,737,802 4/1988 Mielke ..... 417/413.1
4,939,405 7/1990 Okuyama et al. ..... 417/413.2

FOREIGN PATENT DOCUMENTS

4321082C2 1/1993 Germany .

OTHER PUBLICATIONS

Japanese patent abstract "Blast Head For Ink Jet" dated 18 Mar. 1978. Application No. 51-103316.

*Primary Examiner*—Timothy Thorpe
*Assistant Examiner*—Ted Kim
*Attorney, Agent, or Firm*—Rolf Fasth

[57] ABSTRACT

The diaphragm pump includes a housing having an opening defined at one end. A diaphragm is attached to the housing and extends over the opening. An inlet is defined in the housing for receiving a fluid and a driving element is attached to the housing and in driving engagement with the diaphragm to vibrate the diaphragm. An orifice is defined in the diaphragm to permit a discharge of the fluid therethrough when the diaphragm is in vibration. A spring is disposed within the housing for biasing a plunger towards the diaphragm so that the plunger sealingly engages the diaphragm.

13 Claims, 2 Drawing Sheets

MEMBRANE TYPE FLUID PUMP

TECHNICAL FIELD AND BACKGROUND OF THE INVENTION

The present invention relates to membrane type fluid pumps where a membrane serves as a wall of a chamber and is made to oscillate by means of electromagnetic and piezoelectric driving means. The membrane causes a fluid disposed inside the chamber and inside the membrane to flow out through one or more holes defined in the membrane.

The known constructions have the drawback of unavoidable leaking that takes place when the driving means are shut off and fluid leaks through the opening or openings defined in the prior art constructions.

One object of the present invention is to provide a new type of membrane pump that does not leak when the pump is not operating.

SUMMARY OF THE INVENTION

One preferred embodiment of the present invention is a membrane type fluid pump having a chamber defined therein that is in fluid communication with a fluid container. The fluid pump also has a driving member, a membrane that closes one open side of the chamber and at least one hole defined in the membrane. The driving member has the ability to cause the membrane to oscillate or swing. One novel feature of the present invention is that a plunge like body is disposed within the chamber and biased by a spring. The body is displaceable relative to the chamber and the membrane and has an end surface that adheres to the side of the membrane when the membrane is in a rest position. More specifically, the body adheres to the side of the membrane that faces towards the interior of the chamber.

DETAILED SPECIFICATION

Figure 1:
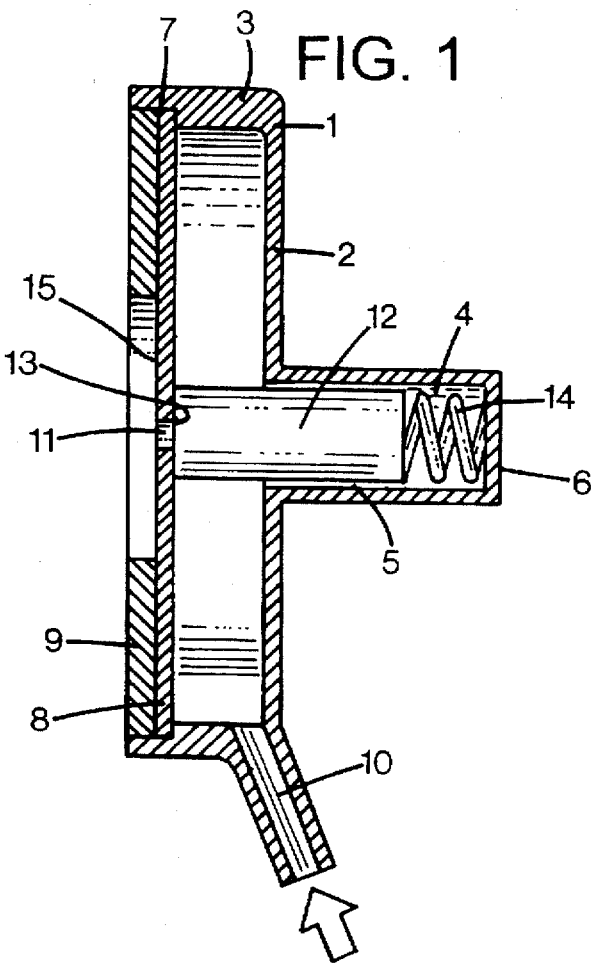
FIG. 1 is a schematic cross sectional view of a preferred embodiment of the membrane type pump of the present invention.

With reference to FIG. 1, a casing or housing 1 is shown. The casing 1 has a bottom 2 and an enclosing wall 3 that is attached to a periphery of the bottom 2. A recessed bore 4 is defined by a cylindrical wall portion 5 and a bottom 6 at the center of the bottom 2. The wall 3 has a free edge defining a step-like recess 7 for receiving a diaphragm 8 and a preferably annular driving core operating member 9. The casing 1 also includes a nipple 10 or the like for defining a fluid channel for carrying fluid from a container or other fluid source.

Adjacent to a central portion of the diaphragm 8 is preferably one or more perforations 11 defined.

A plunger 12 is inserted into the central cylindrical recess 4 inside the casing 1. The plunger 12 may, for example, be a cylindrical body having an end surface 13 that is facing outwardly toward the diaphragm 8. The plunger 12 may also have an inwardly facing end surface having a compression spring 14 disposed between the bottom 6 and the inwardly facing end surface.

Figure 2:
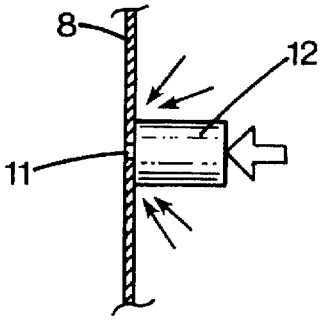
FIG. 2 is a schematic cross sectional view showing a portion of the present invention in a smaller scale when the pump is in a closed rest position.

FIGS. 1 and 2 illustrate the position of the diaphragm 8 and the plunger 12 in a rest position. The spring 14 holds the end surface 13 of the plunger 12 in engagement with the inner side of a central portion 15 of the diaphragm 8 having one or more perforations 11 defined therein. The arrows in FIG. 2 indicate how the fluid is prevented from entering into the space between the plunger 12 and the diaphragm 8 and from leaking out therefrom. In this position, the plunger 12 can be regarded as being like a valve body that engages a valve seat.

Figure 3:
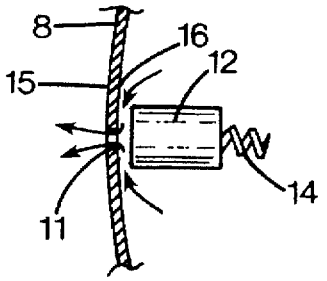
FIG. 3 is a schematic cross sectional view when the pump is in an operational position.
Figure 4:
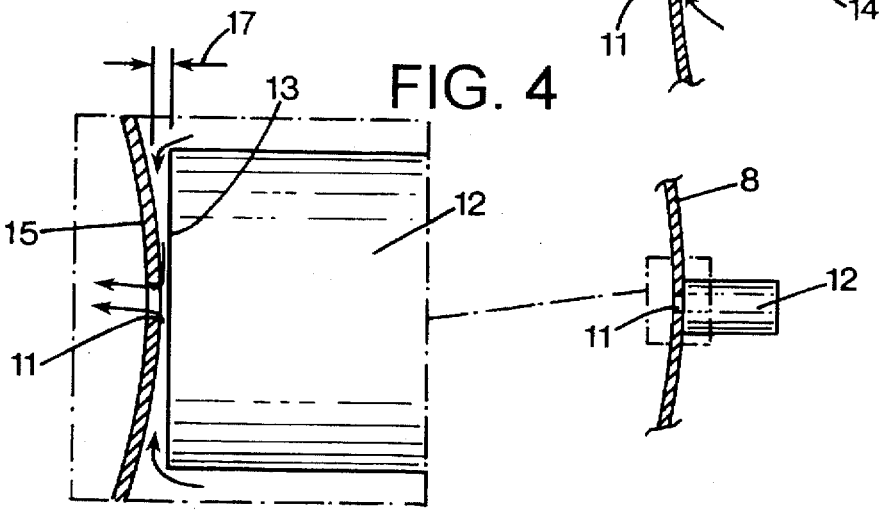
FIG. 4 is a schematic cross sectional view when the pump is in an operational position.

FIGS. 3 and 4 illustrate how the diaphragm 8 is made to vibrate or oscillate by means of the driving member 9 and the diaphragm 8 may flex in one or the other direction. FIG. 3 illustrates how the diaphragm 8 has flexed outwardly so that its central portion 15 is moved away from the end surface 13 of the plunger 12 and how the spring 14 is unable to move the plunger 12 quickly enough so that its end surface 13 is kept in continual engagement with the inside surface of the diaphragm. This inability is due to the inertia of the plunger and the spring. As a result, a gap or space 16 is defined between the diaphragm 8 and the end surface 13 of the plunger 12. The fluid may enter into this space 16, as indicated by the arrows in FIG. 3. When the driving member 9 is urging the diaphragm 8 in the opposite direction, the fluid may enter the space 16 between the surface 13 and the central portion 15. The diaphragm 8 that is approaching the end surface 13 will cause the fluid to leave the space 16 through the hole or the holes 11 disposed at the central portion of the diaphragm. A certain amount of the fluid disposed in the space 16 may be pressed out radially along the inside of the diaphragm area and remain inside the casing 1.

The enlarged cut out portion of FIG. 4 shows a space 17 defined between the diaphragm 8 and the plunger 12. This space 17 appears when the diaphragm 8 flexes inwardly and meets the plunger 12. The figure also shows how the fluid adjacent the end surface 13 of the plunger 12 is sucked inwardly towards the holes 11 and ejected therefrom by the current or suction forces at the holes 11.

The figure only shows an embodiment of the present invention when both the diaphragm 8 and the end surface 13 of the plunger 12 are flat. The plunger 12 that engages the diaphragm portion is also flat.

Figure 5:
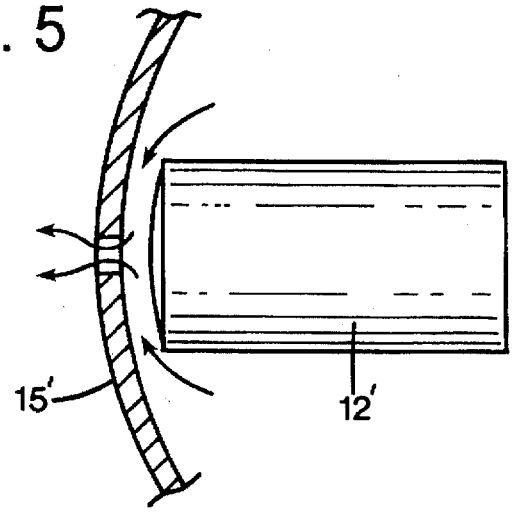
FIG. 5 is a side view of a portion of a second embodiment of the present invention.
Figure 6:
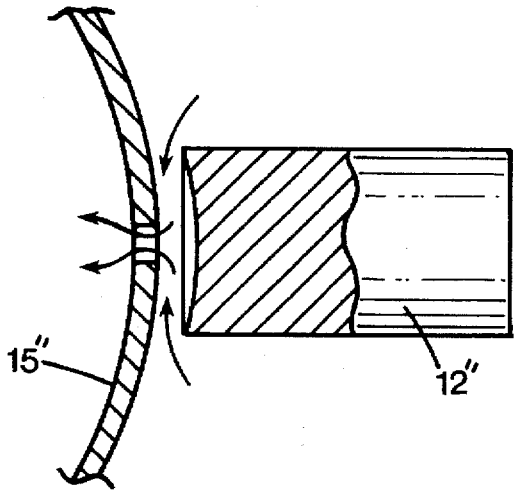
FIG. 6 is a side view of a portion of a third embodiment of the present invention.

It should be understood that the diaphragm 8 may be shaped differently. Accordingly, the membrane or a portion of the membrane that is opposite the plunger 12 or the body 12 when the plunger is in its rest position may be convex or concave shaped in order to provide a sufficient seal when the plunger is in its rest position, as shown by membranes 15' and 15" in FIGS. 5 and 6, respectively. Complimentary concave and convex shaped plungers 12' and 12" are also shown in FIGS. 5 and 6, respectively.

Figure 7:
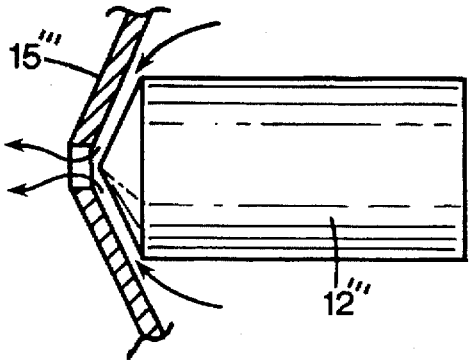
FIG. 7 is a side view of a portion of a fourth embodiment of the present invention.

It is also possible to use a more or less conically shaped diaphragm 15'" and a conically shaped end surface of a plunger 12'" that is adapted to sealingly engage the conically shaped diaphragm 15'", as shown in FIG. 7.

In the embodiments shown, the plunger only moves at a right angle towards the diaphragm but it should be understood that essentially the same effect may be achieved if the plunger moves along a path that is oblique relative the diaphragm.

The invention is not to be regarded as limited to the embodiments described herein and shown in the figures but can be modified in several ways within the scope of the appended claims.

I claim:

1. A diaphragm pump comprising:

a housing having an opening defined at one end;

a diaphragm attached to the housing to extend over the opening;

an inlet defined in the housing for receiving a fluid;

a driving element attached to the housing, the driving element being in driving engagement with the diaphragm to vibrate the diaphragm;

an orifice defined in the diaphragm, the orifice being adapted to permit a discharge of the fluid therethrough;

a plunger disposed within the housing, the plunger being movable within the housing; and a spring disposed within the housing for biasing the plunger towards the diaphragm so that the plunger sealingly engages the diaphragm.

2. A diaphragm pump according to claim 1, wherein the plunger is a substantially cylindrical body having two opposite end surfaces, one of the end surfaces facing the diaphragm and the opposite end surface facing the spring.

3. A diaphragm pump according to claim 1 wherein the housing has a protrusion having a bottom, the protrusion defining a recess adapted for receiving the plunger and the spring, the spring being disposed between the plunger and the bottom.

4. A diaphragm pump according to claim 1 wherein the diaphragm has a periphery and the driving element is annular and disposed at the periphery of the diaphragm.

5. A diaphragm pump according to claim 1 wherein the diaphragm is movable between a most inward position and a most outward position relative to the housing, the spring providing a biasing force against the plunger to bias the plunger to touch the diaphragm when the diaphragm is in its most inward position.

6. A diaphragm pump according to claim 1 wherein the spring provides a biasing force that is adapted to bias the plunger against the diaphragm so that the plunger sealingly engages the diaphragm and covers the orifice.

7. A diaphragm pump according to claim 1 wherein at least a portion of the diaphragm is flat and one end of the plunger is flat.

8. A diaphragm pump according to claim 1 wherein at least a portion of the diaphragm is convex shaped when the diaphragm is in a rest portion and one end of the plunger is curved and adapted to fit into the convex shaped diaphragm.

9. A diaphragm pump according to claim 1 wherein at least a portion of the diaphragm is conical shaped when the diaphragm is in a rest position and one end of the plunger is conical shaped and adapted to fit into the conical shaped diaphragm.

10. A diaphragm pump according to claim 1 wherein the driving element is a piezoelectric device.

11. A diaphragm pump according to claim 1 wherein the driving element is an electromagnetic device.

12. A diaphragm pump according to claim 1 wherein the diaphragm is adapted to oscillate relative to the housing.

13. A diaphragm pump according to claim 1 wherein at least a portion of the diaphragm is concave shaped when the diaphragm is in a rest portion and one end of the plunger is curved and adapted to fit into the concave shaped diaphragm.

* * * * *